United States Patent [19]

Paul

[11] Patent Number: 4,929,177

[45] Date of Patent: May 29, 1990

[54] TRANSFER APPARATUS FOR LATERALLY TRANSFERRING KILN CARS BETWEEN TUNNEL KILNS

[75] Inventor: Ernst Paul, Kotz, Fed. Rep. of Germany

[73] Assignee: LINGL GmbH & Co. KG, Neu-Ulm, Fed. Rep. of Germany

[21] Appl. No.: 269,691

[22] Filed: Nov. 10, 1988

[30] Foreign Application Priority Data

Nov. 13, 1987 [DE] Fed. Rep. of Germany ..... 3738527

[51] Int. Cl.[5] ..... F27B 9/02; F27D 3/00

[52] U.S. Cl. ..... 432/11; 432/241; 432/239

[58] Field of Search ..... 432/239, 241, 243, 250, 432/253, 124.11, 9, 137; 414/154

[56] References Cited

U.S. PATENT DOCUMENTS

| | | | |
|---|---|---|---|
| 3,063,878 | 11/1962 | Wilson | 432/11 |
| 3,778,221 | 12/1973 | Bloom | 432/11 |
| 4,421,481 | 12/1983 | Holz et al. | 432/239 |
| 4,627,814 | 12/1986 | Hattori et al. | 432/239 |

*Primary Examiner*—Henry C. Yuen

*Attorney, Agent, or Firm*—Nixon & Vanderhye

[57] ABSTRACT

An especially adapted kiln car transfer apparatus includes a transfer carriage for supporting at least one kiln car. The transfer carriage itself is supported upon transverse tracks (i.e., relative to the longitudinal dimension of the tunnel kilns with which the transfer apparatus is associated) so as to be capable of movements between adjacent ends of a pair of tunnel kilns. A generally inverted U-shaped housing is carried by the transfer carriage and defines an interior space sized and configured to accept a kiln car. A reciprocally movable wall structure is disposed within the housing's interior space. The wall structure may thus move between the opposing open ends of the housing in response to the continual advancement of the kiln car onto the transfer carriage, and hence, into the interior space defined by the housing. In such a manner, the movable wall minimizes heat build-up within the transfer apparatus, since only a minimal region of the transfer apparatus is exposed directly to heat radiating from the ware at any give time during the transfer operation. Preferably, transverse seals are associated with the movable wall structure and are adapted to provide a thermal barrier between the kiln car and the carriage assembly.

38 Claims, 3 Drawing Sheets

TRANSFER APPARATUS FOR LATERALLY TRANSFERRING KILN CARS BETWEEN TUNNEL KILNS

FIELD OF INVENTION

This invention is related to the field of tunnel kilns adapted to cure refractory materials loaded upon kiln cars which pass through the kiln in train formation. More specifically, the invention is directed to novel transfer apparatus especially adapted to transfer kiln cars from one tunnel kiln to another. In one specific form, the invention is embodied in a transfer apparatus having a carriage structure carrying a housing which defines an interior space sized and configured to accept a kiln car therein. A movable wall is disposed in this defined interior space and moves in response to the kiln car's transference onto/from the carriage structure. In this way, exposure of the carriage structure to heat radiating from the refractory material is minimized.

BACKGROUND AND SUMMARY OF THE INVENTION

During the production of cured refractory material (e.g., bricks, tiles, ceramics and the like which will hereinafter be collectively referred to as "ware"), kiln cars are continually recycled from the exit of the tunnel kiln (after the cured ware has been off-loaded) to a marshalling track (where uncured ware is placed upon the kiln car in preparation for its entry into the tunnel kiln). It is therefore oftentimes necessary for transfer cars to be employed at entrances/exits of tunnel kilns in order to direct kiln cars between the marshalling tracks and the exit/entrance of the tunnel kiln.

Sometimes, the marshaling tracks are a part of a preheater or cooling tunnel which is disposed adjacent to the tunnel kiln—that is, the marshalling tracks are completely enclosed by a housing making them, in essence, an integral part of the tunnel kiln. The kiln cars loaded with ware may therefore be transferred to/from the tunnel kiln within the enclosed marshalling tracks so that the ware is preheated or cooled to the desired extent. This known practice of transferring kiln cars along marshalling tracks in a closed housing, however, is disadvantageous since the entire kiln car is subjected to elevated temperatures which may be damaging to the kiln car's undercarriage.

A kiln car transfer system is also known (Swindell-Dressler Tunnel Kiln in use with Globe Brick, Ohio, USA) which includes an insulated housing adapted to accommodate a kiln car. The housing itself is capable of being moved along tracks in the longitudinal direction of the tunnel kiln. However, one significant disadvantage of this prior system is that the kiln car mechanisms which transfer the kiln car to/from the tracks in the housing may be elevated to extreme temperatures by virtue of heat radiating from the cured ware unless the kiln car transfer is accomplished within a minimal time frame.

What has been needed in this art, therefore, is a transfer apparatus onto which kiln cars may be advanced so as to accommodate upstream tunnel kiln processing, while at the same time, protect the transfer mechanisms from excessive heat radiating from the ware loaded on the kiln car. It would also be highly desirable if the radiated heat from the ware was minimized so as to, in turn, minimize any adverse effect which may result from the ware being cooled to an undesirable extent. It is towards satisfying such needs that the present invention is directed.

According to the present invention, an especially adapted kiln car transfer apparatus is provided which includes a transfer carriage for supporting at least one kiln car. The transfer carriage itself is supported upon transverse tracks so as to be capable of movements between adjacent ends of a pair of tunnel kilns.

A generally inverted U-shaped housing is carried by the transfer carriage and defines an interior space sized and configured to accept a kiln car. Important to the present invention is the disposition of a movable wall structure within the housing's interior space. The wall structure may thus move reciprocally between the opposing open ends of the housing in response to the continual advancement/discharge of the kiln car onto/from the transfer carriage, and hence, into/from the interior space defined by means of the housing. In such a manner, the movable wall minimizes heat build-up within the transfer apparatus, since only a minimal region of the transfer apparatus is potentially exposed directly to heat radiating from the ware at any give time during the transfer operation—i.e., due to the moveable wall effectively blocking the radiated heat. Heat build-up is further minimized by transverse seal structures associated with the movable wall which provide a transverse thermal seal between the movable wall and the kiln car. Hence, this transverse seal structure effectively thermally isolates the undercarriage of the kiln car and the transfer carriage from the heated ware borne by the kiln car.

The housing itself may be mounted for movements towards and away from the tunnel kiln with which it is aligned. This capability of the present invention allows the housing to, in essence, be an integral extension of the tunnel kiln (so as to minimize, if not eliminate, thermal "shock" on the ware and/or to substantially maintain the internal environment of the tunnel kiln) when the kiln cars are transferred onto/from the transfer carriage. Moveable mounting of the housing also facilitates its separation from the tunnel kiln when the kiln car is to be transferred to another tunnel kiln via the transfer carriage.

These, and other aspects and advantages of the present invention will become more apparent after careful consideration is given to the detailed description of the preferred exemplary embodiments thereof which follows.

BRIEF DESCRIPTION OF THE ACCOMPANYING DRAWINGS

Reference will hereinafter be made to the accompanying drawings wherein like reference numerals throughout the various FIGURES denote like structural elements, and wherein.

DETAILED DESCRIPTION OF THE PREFERRED EXEMPLARY EMBODIMENTS

Figure 1:
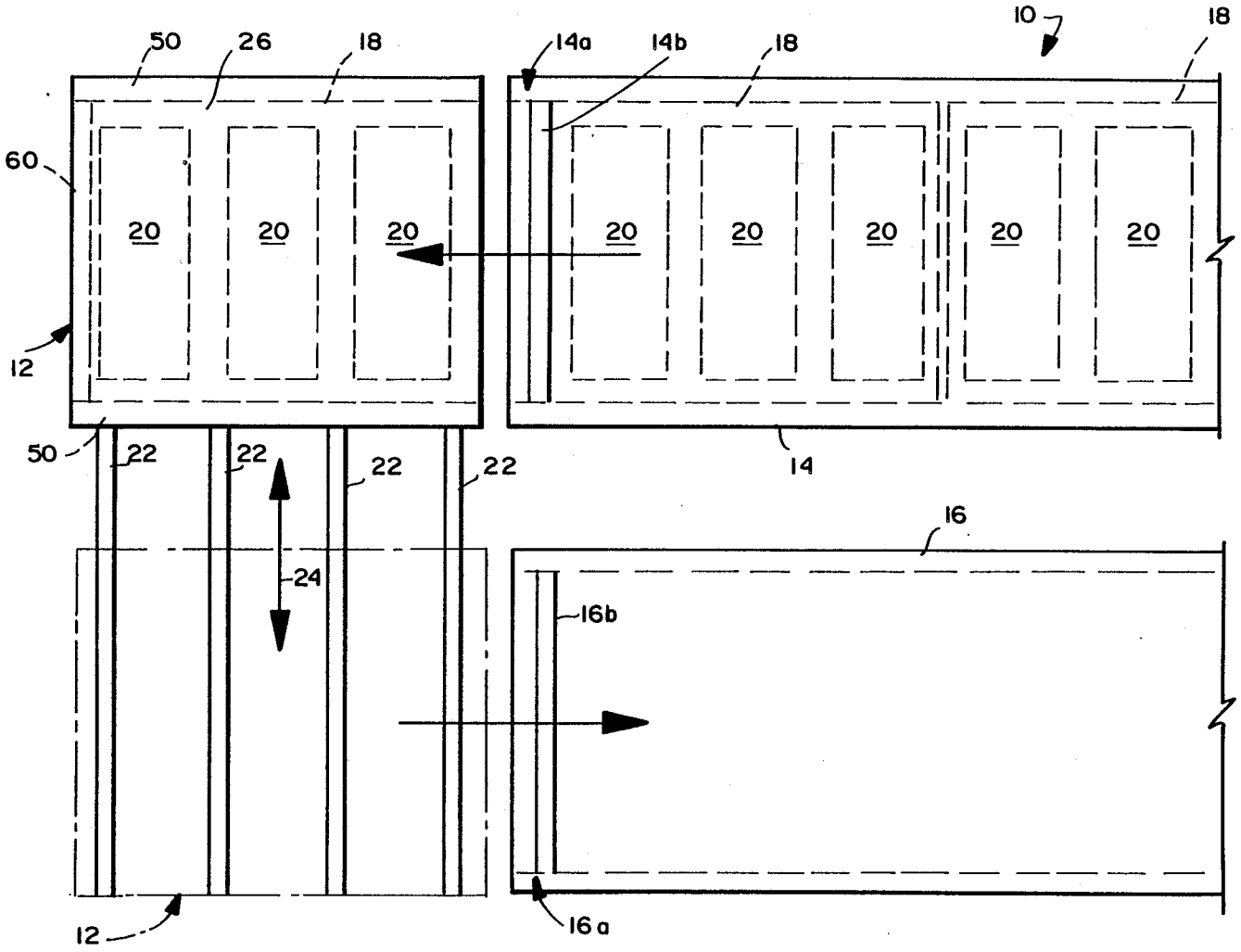
FIG. 1 is a schematic top plan view of a tunnel kiln system having a kiln car transfer apparatus according to the present invention.

A tunnel kiln system 10 which employes a transfer apparatus 12 according to the present invention is schematically depicted in accompanying FIG. 1 in plan view. As is seen, the tunnel kiln system 10 includes a pair of elongate tunnel kilns 14, 16 disposed in side-by-side parallel relationship. Each of the tunnel kilns 14, 16 is adapted to receiving a number of kiln cars 18 in a train formation (only two kiln cars 18 are shown in accompanying FIG. 1 for clarity of presentation) and upon which stacks of ware 20 are carried. Preferably, the tunnel kilns 14, 16 are constructed according to, U.S. Pat. Nos. 4,744,750; 4,722,682; and/or U.S. Pat. No. 4,778,384, the entire content of each being expressly incorporated hereinto by reference.

The transfer apparatus 12 is mounted upon transverse tracks 22 for reciprocal movements (arrow 24) between the exit end **14*a* of tunnel kiln 14 and the entrance end 16*a* of tunnel kiln 16. As will be explained in greater detail below, the transfer apparatus carries a housing 26 which accommodates a kiln car 18 which is discharged from the exit end 14*a* of the tunnel kiln 14 by virtue of the sequential advancement of the kiln cars 18 therewithin. When the kiln car 18 is completely accepted within the housing 26, the transfer apparatus 12, and hence the housing 26/kiln car 18 carried thereby, may then be laterally transferred along tracks 22 until it is in alignment with the entrance end 16*a* of tunnel kiln 16. The kiln car 18 within the housing 26 may thus be introduced into the tunnel kiln 16** for further processing.

Figure 2:
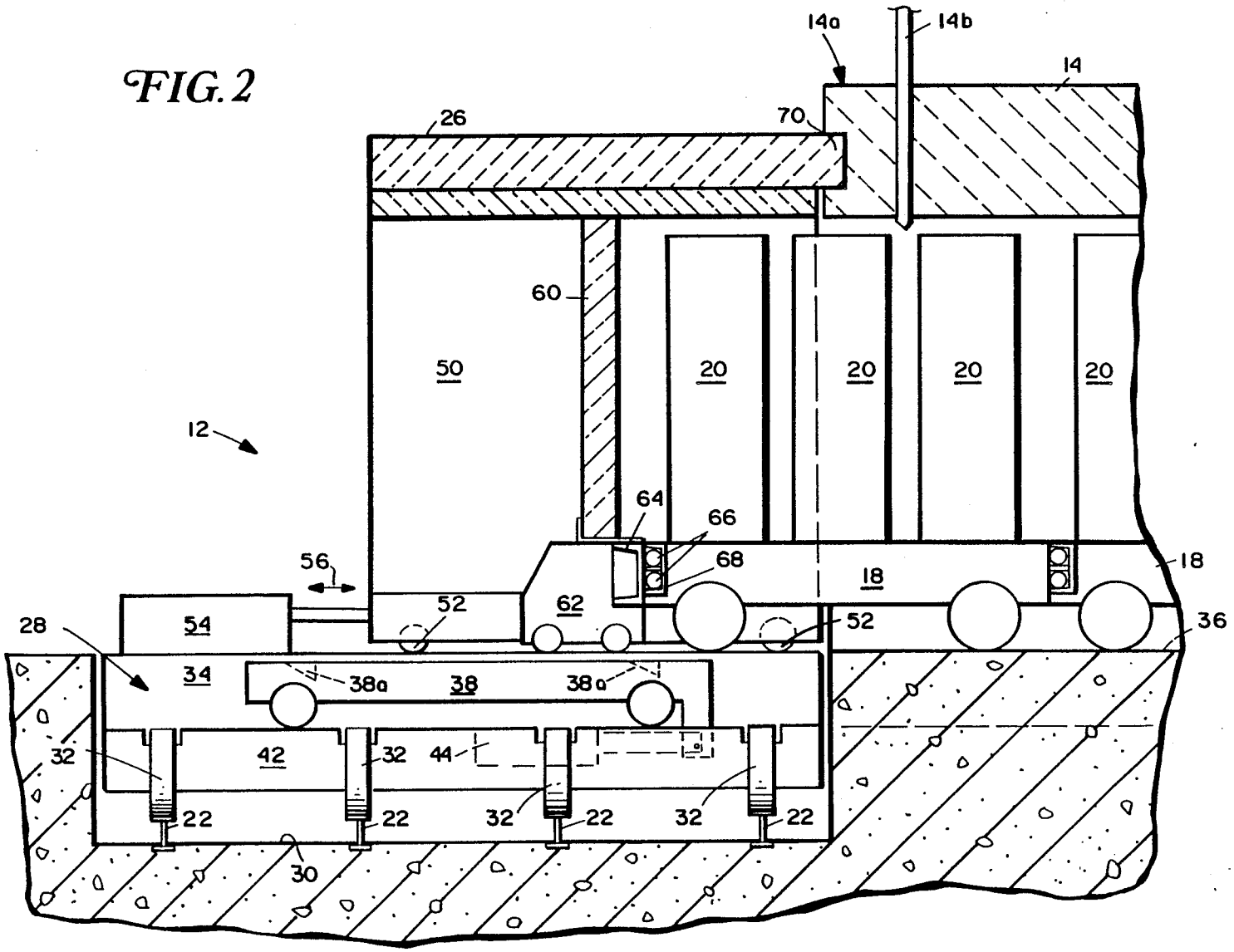
FIG. 2 is a side elevational view of the kiln car transfer apparatus in a state where a kiln car is being accepted thereinto.
Figure 3:
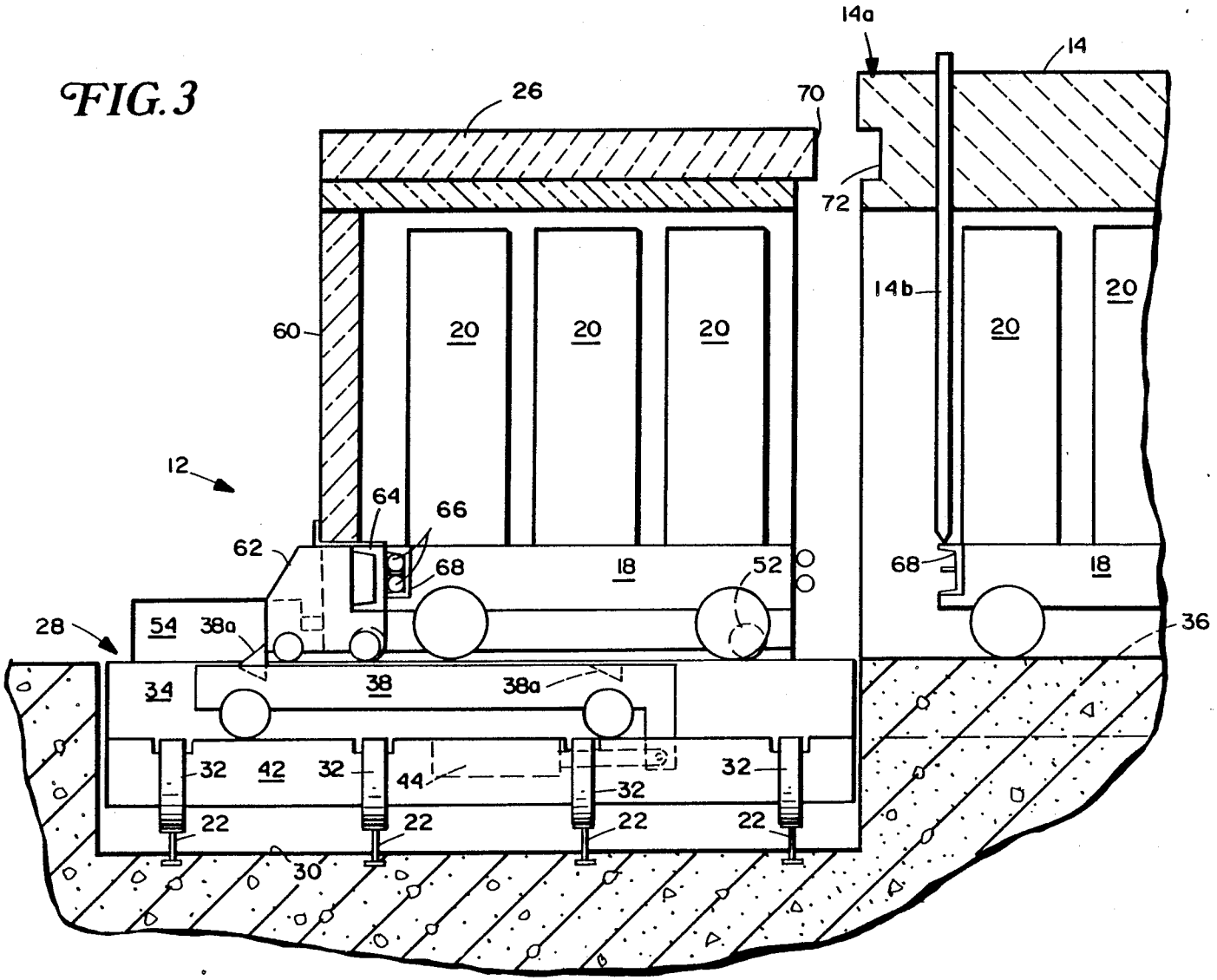
FIG. 3 is a side elevational view of the kiln car transfer apparatus in a state whereby the kiln car may be laterally transferred between tunnel kilns.

As is perhaps more clearly seen in FIGS. 2 and 3, the transfer apparatus 12 includes a transfer carriage assembly 28 disposed in transfer pit 30. The transfer carriage assembly 28 includes a number of wheels 32 supported upon respective ones of the transfer tracks 22 so that the entire carriage assembly 28 is capable of being moved therealong. Any suitable drive means well known to those in the mechanical arts may be employed to propel the carriage assembly 28 along the tracks 22 (i.e., in reciprocal directions as shown by arrow 24 in FIG. 1).

The carriage assembly 28 includes a pair of tracks 34 (only one track 34 being visible in FIGS. 2 and 3) which form extensions of the tracks 36 in the tunnel kiln 14 when the carriage assembly 28 is in alignment with end **14*a* thereof (and with the tracks of the tunnel kiln 16 when the carriage assembly 28 is aligned with end 16*a* thereof). Thus, as the last kiln car 18 is sequentially advanced through tunnel kiln 14, it will be discharged from the exit end 14*a* and onto the tracks 34 of carriage assembly 28**.

A transfer mechanism 38 is rollably mounted upon secondary tracks 42 rigidly associated with the carriage assembly 28. The transfer mechanism 38 is moved reciprocally along the secondary tracks 42 via a hydraulic actuator 44 carried by the carriage assembly 28. The transfer mechanism 38 shown in accompanying FIGS. 2 and 3 is of a well known variety and includes retractable dogs **38*a* which serve, for example, to engage the undercarriage of the kiln cars 18 and assist in its transference onto/from the tracks 34. Although a hydraulic actuator just happens to be shown in FIGS. 2 and 3, those in this art will, of course, appreciate that any suitable motive means may be employed to cause desired movements of the transfer mechanism 38**.

The carriage assembly 28 carries an open ended generally inverted U-shaped housing 26 as was briefly discussed above. More specifically, the housing side walls 50 (only one side wall 50 being shown in FIGS. 2 and 3, but see FIG. 1) are rollably supported upon tracks (not shown, but which are laterally adjacent the tracks 34) via wheels 52 for movements towards and away from the tunnel kiln ends **14*a*, and 16*a* (i.e., when the carriage assembly 28 brings the housing 26 into respective alignment with the tunnel kilns 14 and 16). Motive means 54 (which may be in the form of a hydraulic piston actuator, for example) is connected to the housing 26 so as to provide the motive force for reciprocally moving the housing 26 in the directions noted by arrow 56. Thus, motive means 54 moves the housing 26 between a mated position (as shown in FIG. 2), and a separated position (as shown in FIG. 3), with respect to the tunnel kiln 14 (and tunnel kiln 16 when the housing 26** is aligned therewith).

Important to the present invention is the provision of a movable wall 60 disposed in the interior space established between the open ends of the housing 26. Although any suitable mounting assemblies may be employed to mount the wall 60 for reciprocal rectilinear movements (i.e., movements in the direction of arrow 56) within the housing 26, it is presently preferred that the wall 60 be rigidly supported upon a dolly 62 that is capable of rolling along the tracks 34 of carriage assembly 28.

The dolly 62 includes a forwardly facing (i.e., facing in a direction towards the tunnel kilns 14 and 16) stop element 64 having a pair of transverse seals 66 formed of suitable high temperature material. These seals 66 are accepted within a recessed bumper 68 of the kiln car 18 and thus serve to minimize heat transfer to the kiln car's undercarriage (and also to the carriage assembly 28). Since the wall 60 is itself constructed of a thermally insulated material, heat transfer to the ambient environment is also minimized. Hence, the wall 60 and the seals 66 collectively serve to minimize the carriage assembly's 28 exposure to heat radiating from the ware 20. The interior of the housing 26 on the side of wall 60 facing the tunnel kiln 14 is therefore maintained substantially at the same temperature and with the same atmosphere as may be present within the tunnel kiln 14.

As was briefly mentioned above, the transfer mechanism 38 may assist the transfer of the kiln car 18 from the tunnel kiln 14 and onto the tracks 34 of the carriage assembly 28. In use therefore, the forwardmost kiln car 18 in the kiln car train (i.e., relative to the direction of travel of the train) passing through the tunnel kiln 14 will initially be advanced onto the tracks 34 of the carriage assembly 28 by virtue of the continual movement of the kiln car train through the tunnel kiln 14 by means not shown. The transfer mechanism 38 may then be operated so the the dogs **38*a* engage the undercarriage of the kiln car 18 and/or the dolly 62 so as to "pull" the kiln car 18 completely onto the the tracks 34 of the carriage assembly 28. Thereafter, the motive means 54 may be operated so as to move the housing 26 along the tracks 34 from its mated position (as is shown in FIG. 2) and into its separated position (as is shown in FIG. 3**).

With the housing 26 separated from the tunnel kiln 14, and with the kiln car 18 completely supported upon the tracks 34 (i.e., the condition as shown in FIG. 3), the transfer apparatus 12 may then be moved along tracks 22 so as to bring the housing 26 (and the kiln car 18 carried thereby) into alignment with the end **16*a* of tunnel kiln 16. Thereafter, one or more of the retractable dogs 38*a* may be extended into engagement with the undercarriage of the kiln car 18 and/or the dolly 62, and the hydraulic actuator 44 operated so as to "push" the kiln car 18 towards the entrance 16a of the tunnel kiln 16. In such a manner, the kiln car 18 carried upon the carriage assembly 28 is transferred into the tunnel kiln 16. After the kiln car 18 has been off-loaded from the transfer apparatus 12, the transfer apparatus 12 may then be returned along tracks 22 so that the housing 26 is in its starting position in alignment with the exit end 14a of tunnel kiln 14 (i.e., in a position shown in solid line in FIG. 1**.

It will be appreciated that, after the kiln car 18 has been transferred from the carriage assembly 28 and into the tunnel kiln 16, the wall 60 will be positioned closely adjacent the entrance end 16a of tunnel kiln 16. Thus, when the transfer apparatus 12 returns to its aligned position with the exit end 14a of tunnel kiln 14, the wall 60 will, in effect, "close" tunnel kiln 14. In any event, the wall 60 is then in the proper position to mate with the next sequential one of the kiln cars 18 and to be moved rearwardly (relative to the kiln car's discharge direction from the tunnel kiln 14) in the interior space of housing 26.

In order to ensure that the temperature and/or atmospheric environment within the tunnel kilns 14, 16 are maintained to within acceptable tolerances, the ends 14a, 16a are preferably provided with vertically movable partitions 14b, 16b, respectively. In addition, it will be observed particularly in FIGS. 2 and 3 that the upper wall of the housing 26 includes an integral flange 70 which extends towards a recess 72 formed in the upper wall of the tunnel kiln 14. (A similar recess is formed in the upper wall of the tunnel kiln 16, but is not shown in the accompanying drawing FIGURES). Therefore, when the housing is in the position shown in FIG. 2, the flange 70 mates with the recess 72 so that the housing 26, in essence, forms an extension of the tunnel kilns and minimizes heat dissipation and/or atmospheric changes within the tunnel kiln during transference of the kiln cars 18 into the housing 26 as was previously described.

Although a transfer mechanism 38 has been described as being a part of the carriage assembly 28, any suitable mechanical equivalent could be successfully employed in the practice of this invention. For example, a transfer mechanism (i.e., continuous chain and hook assembly) could physically be associated within the tunnel kilns 14 and/or 16 so as to push/pull the kiln cars 18 therealong. In such an alternative equivalent arrangement, it is desirable that automatic latching mechanisms be provided as part of the dolly 62 to allow the kiln car 18 to be coupled to the dolly 62 whereby the wall 60 may be moved in response to movement of the kiln car 18. Of course, automatic uncoupling of the dolly 62 and kiln car 18 must also be provided so that the kiln car 18 may proceed into the tunnel kiln 16, and so that the transfer apparatus 12 may return to its original position in alignment with the tunnel kiln 14.

Any number of automated latching systems may be envisioned. Thus, in one form, such a system could be accomplished using pivotal hooks associated with the dolly and with appropriate cam surfaces associated with the kiln cars 18 and the entrance end 16a of tunnel kiln 16. That is, upon relative approaching movement between the cam surfaces and the hooks, the latter will be pivoted by virtue of its interengagement with the cam surfaces and hence allow the hooks to be coupled to, and uncoupled from, the kiln car 18.

Therefore, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A transfer apparatus for transferring a kiln car relative to a tunnel kiln, said transfer apparatus comprising:

(a) a transfer carriage including (i) a housing structure which defines a space longitudinally alignable with an end of said tunnel kiln for accommodating a kiln car which is transferred form said tunnel kiln end and into said defined space of said housing structure, and (ii) a wall disposed within said defined space; and (b) mounting means for mounting said wall relative to said housing structure for reciprocal longitudinal movements within said defined space between forward and rearward positions, said wall being farther from said tunnel kiln end when in said rearward position as compared to said forward position thereof so as to allow said transferred kiln car to be accommodated within said defined space.

2. A transfer apparatus as in claim 1, wherein said transfer carriage includes primary track means alignable with said tunnel kiln for supporting said kiln car when the same is transferred relative to said tunnel kiln.

3. A transfer apparatus as in claim 1, wherein said housing structure includes a thermally insulated inverted U-shaped housing having a pair of separated side walls and an upper wall joined to upper ends of said side walls.

4. A transfer apparatus as in claim 1, which further comprises seal means for providing a thermal seal between said wall and said kiln car.

5. A transfer apparatus for transferring a kiln car relative to a tunnel kiln, said transfer apparatus comprising:

(a) a transfer carriage including a housing structure which defines a space for accommodating said kiln car, and a wall disposed within said defined space; and (b) mounting means for mounting said wall relative to said housing structure for reciprocal movements within said defined space, wherein said housing structure includes (i) a thermally insulated inverted U-shaped housing having a pair of separated side walls and an upper wall joined to upper ends of said side walls, and (ii) means associated with a lower end of each said aide wall for supporting said housing structure upon said transfer carriage to allow said housing structure to be reciprocally movable between a first position, wherein said housing structure is closely adjacent an end of said tunnel kiln, and a second position, wherein said housing structure is separated from said tunnel kiln end.

6. A transfer apparatus as in claim 5 wherein said housing structure includes motive means for moving said wall structure between said first and second positions.

7. A transfer apparatus as in claim 1 or 5, wherein said mounting means includes a dolly upon which said wall is supported and operatively associated with said transfer carriage for relative reciprocal movements towards and away from said tunnel kiln.

8. A transfer apparatus as in claim 7, wherein said dolly includes a stop element for engagement with an end of said kiln car in confronting relationship thereto.

9. A transfer apparatus as in claim 8, wherein said stop element includes seal means engageable with said confronting end of said kiln car for providing a thermal seal therebetween.

10. A transfer apparatus for transferring a kiln car relative to a tunnel kiln comprising:

transfer carriage means for supporting at least one kiln car and for transferring said kiln car relative to a tunnel kiln; and a housing operatively associated with said carriage means and defining an interior space having opposing open ends alignable with said tunnel kiln and adapted to receiving said kiln car when said kiln car is transferred onto, and supported by, said carriage means; said housing including, (i) a wall disposed within said interior space, (ii) mounting means for mounting said wall for reciprocal rectilinear movements therewithin between said opposing open ends thereof, and (iii) means for allowing said housing to be reciprocally movable between a first position, wherein said housing is closely adjacent to an end of said tunnel kiln, and a separated position, wherein said housing is separated from said tunnel kiln end.

11. A transfer apparatus as in claim 10, wherein said means for allowing said housing to be reciprocally movable includes track means associated with said transfer carriage means which define a path of movement of said housing between said first and second positions thereof, wheel means rollably supported upon said track means to allow said housing to move along said defined path, and motive means for moving said housing along said defined path between said first and second positions.

12. A transfer apparatus as in claim 10, wherein said transfer carriage includes a transfer mechanism which is engageable with at least one of said kiln car and said wall for assisting in the transfer of said kiln car onto and from said transfer carriage.

13. A transfer apparatus as in claim 10, wherein said mounting means includes a dolly upon which said wall is supported, said dolly being operatively associated with said transfer carriage for relative reciprocal movements towards and away from said tunnel kiln.

14. A transfer apparatus as in claim 13, wherein said dolly includes a stop element for engagement with an end of said kiln car in confronting relationship thereto.

15. A transfer apparatus as in claim 14, wherein said stop element includes seal means engageable with said confronting end of said kiln car for providing a transverse thermal seal therebetween.

16. In a tunnel kiln system of the type having at least one pair of elongate tunnel kilns, and a number of kiln cars adapted to pass in train formation through said tunnel kilns, the improvement comprising transfer means for sequentially transferring said kiln cars from an exit end of one of said pair of tunnel kilns to an entrance end of another of said pair of tunnel kilns, said transfer means including:

transfer carriage means for (i) supporting at least one kiln car discharged from said exit end of said one tunnel kiln, (ii) transferring said supported at least one kiln car between said exit end of said one tunnel kiln and said entrance end of said another tunnel kiln, and (iii) introducing said at least one kiln car into said another tunnel kiln at said entrance end thereof;

a housing carried by said transfer carriage means and defining a pair of open ends alignable with said exit and entrance ends of said one and another elongate tunnel kilns, respectively, said open ends establishing therebetween a space for accommodating said at least one kiln car; and a wall structure disposed within said space and including means for movably mounting said wall structure relative to said housing for reciprocal movements between said open ends thereof.

17. In a tunnel kiln system as in claim 16, wherein said wall structure includes dolly means movably associated with said transfer carriage for supporting said wall structure and for allowing said wall structure to be reciprocally movable between said open ends of said housing.

18. In a tunnel kiln system as in claim 17, wherein said dolly means includes a stop element engageable with a confronting end of said at least one kiln car.

19. In a tunnel kiln system as in claim 18, wherein said dolly means includes seal means for forming a transverse thermal seal between said wall structure and said at least one kiln car.

20. In a tunnel kiln system as in claim 16, the improvement further comprising seal means operatively associated with said movable wall structure for forming a transverse thermal seal between said wall structure and said at least one kiln car.

21. In a tunnel kiln system as in claim 16, wherein said housing includes means for supporting said housing upon said transfer carriage means to allow said housing to move reciprocally between a mated position, wherein said housing is in mated relationship with a respective one of said exit and entrance ends of said one and another tunnel kilns, and a separated position, wherein said housing is separated from said respective exit and entrance ends of said one and another tunnel kilns.

22. In a tunnel kiln system as in claim 21, wherein said housing includes a flange extending towards said pair of tunnel kilns, and wherein said exit and entrance ends of said one and another tunnel kilns defines a recessed surface for accepting said flange when said housing is in said mated position therewith, respectively.

23. In a tunnel kiln system as in claim 16, wherein said one and another tunnel kilns includes movable partition means operatively associated with said exit and entrance ends for opening and closing said exit and entrance ends, respectively.

24. In a tunnel kiln system as in claim 16, wherein said transfer carriage means includes track means extending between said entrance and exit ends of said one and another tunnel kilns for defining a transfer path, and a transfer carriage assembly mounted said track means for reciprocal movements along said defined transfer path.

25. In a tunnel kiln system as in claim 24, wherein said transfer carriage assembly includes a transfer mechanism engageable with at least one of said kiln car and said wall structure for assisting in the transference of said kiln car onto and from said transfer carriage means.

26. In a tunnel kiln system as in claim 16, wherein said tunnel kilns are substantially parallel to one another.

27. A method of transferring a kiln car relative to a tunnel kiln, said method comprising the steps of:

(a) aligning a carriage structure with an exit end of a tunnel kiln, the carriage structure carrying a housing defining a space for accommodating said kiln car and a wall movably disposed within said defined space;

(b) initially positioning said movable wall adjacent said end of the tunnel kiln; and then (c) allowing the kiln car to advance onto said carriage structure and into said defined space, which advancement causes said movable wall to move from its said initial position towards a final position in said defined space which is spaced in a downstream direction from said initial position thereof.

28. A method as in claim 27, which further comprises the step of (d) transferring said carriage structure so as to align it with an entrance end of another tunnel kiln.

29. A method as in claim 28, wherein step (d) is practiced sequentially after step (c).

30. A method as in claim 28, further comprising the step of (e) discharging said kiln car into said entrance end of said another tunnel kiln.

31. A method as in claim 30, wherein step (e) includes causing said wall to movably advance with said kiln car as the latter is discharged into said entrance end of said another tunnel kiln.

32. A method as in claim 31, which further comprises the step of returning said carriage structure to said exit end of said one tunnel kiln after said kiln car has been discharged into said another tunnel kiln.

33. A transfer apparatus for transferring a kiln car relative to a tunnel kiln, said transfer apparatus comprising:

(a) a transfer carriage including a housing structure which defines a space for accommodating said kiln car, and a wall disposed within said defined space; and (b) mounting means for mounting said wall relative to said housing structure for reciprocal movements within said defined space, wherein said mounting means includes a dolly upon which said wall is supported and operatively associated with said transfer carriage for relative reciprocal movements towards and away from said tunnel kiln.

34. A transfer apparatus as in claim 33, wherein said dolly includes a stop element for engagement with an end of said kiln car in confronting relationship thereto.

35. A transfer apparatus as in claim 34, wherein said stop element includes seal means engageable with said confronting end of said kiln car for providing a thermal seal therebetween.

36. A transfer apparatus for laterally transferring a kiln car between one and another tunnel kilns, comprising:

a housing structure defining a space for accommodating a kiln car transferred from an end of said one tunnel kiln; and transfer carriage means for (i) supporting said housing for reciprocal movements relative to said one tunnel kiln end between a first position, wherein said housing structure is closely adjacent said one tunnel kiln end, and a second position wherein said housing structure is separated from said one tunnel kiln end, and (ii) allowing said housing structure to be alignable with said one and another tunnel kilns, and to permit lateral conveyance of said housing structure when in said second position thereof between said one and another tunnel kilns, whereby said kiln car accommodated in said housing structure may similarly be conveyed between said one and another tunnel kilns.

37. A transfer apparatus as in claim 36, wherein said housing structure includes a wall, and means for mounting said wall relative to said defined space to allow reciprocal longitudinal movements thereof towards and away from said one and another tunnels kilns.

38. A transfer apparatus for transferring a kiln car relative to a tunnel kiln comprising:

transfer carriage means for supporting at least one kiln car and for transferring said kiln car relative to a tunnel kiln; and a housing operatively associated with said carriage means and including a pair of opposing open ends defining therebetween an interior space which is adapted to being longitudinally alignable with a tunnel kiln and also adapted to receiving a kiln car when the kiln car is transferred onto, and supported by, said carriage means, wherein said housing includes;

(i) a wall disposed within said interior space; and (ii) mounting means for mounting said wall for reciprocal longitudinal movements within said interior space between said opposing ends thereof towards and away from the tunnel kiln.

* * * * *